US009918560B2

(12) United States Patent
Osaki

(10) Patent No.: US 9,918,560 B2
(45) **Date of Patent: *Mar. 20, 2018**

(54) THREE-DIMENSIONAL NET-LIKE STRUCTURE

(71) Applicant: C-ENG CO., LTD., Gamagori-Shi, Aichi-Ken (JP)

(72) Inventor: Hiroko Osaki, Kariya (JP)

(73) Assignee: C-ENG CO., LTD., Gamagori-Shi, Aichi (JP)

( * ) Notice: Subject to any disclaimer, the term of this patent is extended or adjusted under 35 U.S.C. 154(b) by 911 days.

This patent is subject to a terminal disclaimer.

(21) Appl. No.: 14/364,335

(22) PCT Filed: Dec. 14, 2012

(86) PCT No.: PCT/JP2012/008014
§ 371 (c)(1),
(2) Date: Jun. 11, 2014

(87) PCT Pub. No.: WO2013/088737
PCT Pub. Date: Jun. 20, 2013

(65) Prior Publication Data

US 2014/0378015 A1 Dec. 25, 2014

(30) Foreign Application Priority Data

Dec. 14, 2011 (KR) ..... 10-2011-0134777

(51) Int. Cl.
*A47C 31/00* (2006.01)
*A47C 27/12* (2006.01)

(52) U.S. Cl.
CPC ..... *A47C 31/006* (2013.01); *A47C 27/122* (2013.01); *Y10T 442/10* (2015.04)

(58) Field of Classification Search
CPC .... A47C 31/006; A47C 27/122; Y10T 442/10
See application file for complete search history.

(56) References Cited

U.S. PATENT DOCUMENTS 5,608,637 A * 3/1997 Wang ..... B29C 47/92 425/461
7,625,629 B2 12/2009 Takaoka
(Continued)

FOREIGN PATENT DOCUMENTS

JP 2003-183972 A 7/2003
JP 2008-295824 A 12/2008
(Continued)

OTHER PUBLICATIONS

The structure of polyester, Cornell University, Apr. 27, 1996.*
(Continued)

*Primary Examiner* — Elizabeth M Cole
(74) *Attorney, Agent, or Firm* — Matthias Scholl, PC; Matthias Scholl

(57) ABSTRACT

By taking into account the difficulty in smoothly bending along the shape of, for example, a care bed, there is provided a three-dimensional net-like structure made from polyester having a swelling ratio dependent on a shear rate such as to be 1.10 to 1.38 at a shear rate of 60.8 $sec^{-1}$ and 1.17 to 1.43 at a shear rate of 608 $sec^{-1}$ and having an MFR of 3 to 35 g/10 min and a density of 1.01 to 1.60 $g/cm^3$ and configured to have a spring structure of filaments randomly brought into contact with and tangled with one another, have a three-dimensional striped sparse-dense configuration in a lateral direction relative to an extrusion direction. The swelling ratio is shown as $D_2/D_1$ against shear rate when a molten thermoplastic resin is extruded to filaments from a capillary having a tube inner diameter $D_1$ of 1.0 mm and a length of 10 mm and $D_2$ denotes a diameter of cross section of the filaments extruded and cooled down.

7 Claims, 12 Drawing Sheets

(56) References Cited

U.S. PATENT DOCUMENTS

| | | | |
|---|---|---|---|
| 7,892,991 | B2 | 2/2011 | Yamanaka et al. |
| 2006/0198983 | A1 | 9/2006 | Patel |

FOREIGN PATENT DOCUMENTS

| | | | |
|---|---|---|---|
| JP | 2010-154965 | A | 7/2010 |
| JP | 2011-167319 | A | 9/2011 |

OTHER PUBLICATIONS

J. Vlachopoulos et al., The role of rheology in polymer extrusion, [online], <URL: http://www.polydynamics.com/Rheology.pdf>.

V. Ganvir et al., Extrudate swell of linear and branched polyethylenes: ALE simulations and comparison with experiments, Journal of Non-Newtonian Fluid Mechanics, Jan. 2011, pp. 12-24, vol. 166, issue 1-2, Elsevier, Netherlands.

* cited by examiner (a)

(b)

(a)

(b)

(a)

(b)

THREE-DIMENSIONAL NET-LIKE STRUCTURE

This application is a 371 of PCT/JP2012/008014 filed Dec. 14, 2012.

TECHNICAL FIELD

The present invention relates to a three-dimensional net-like structure used for cushions, sofas and beds.

BACKGROUND ART

Patent Literature 1 discloses a three-dimensional net-like structure having voids formed by winding a resin yarn with an endless belt and a production method and a production apparatus of such a three-dimensional net-like structure. Patent Literature 2 discloses a three-dimensional net-like structure made from polyethylene as the material

CITATION LIST

Patent Literature

PTL 1: U.S. Pat. No. 7,625,629
PTL 2: U.S. Pat. No. 7,892,991

SUMMARY OF INVENTION

Technical Problem

When the three-dimensional net-like structure is used as a mattress for a care bed or a sofa bed, there is a need to smoothly bend the mattress along transformation of the bed. When the material used is a specific type of material having a high surface density, such as polyethylene, the texture of the three-dimensional net-like structure is unnaturally deformed with wrinkles or folds caused in the middle during bending of the three-dimensional net-like structure. There is accordingly a difficulty in smoothly bending the three-dimensional net-like structure along the shape of, for example, a care bed. There is also a general requirement in the field of medical treatment and nursing care to produce a mattress that is lighter in weight and has better durability, in order to relieve the load of nurses and care staff.

An object of the invention is accordingly to provide a smoothly-bendable three-dimensional net-like structure made from a thermoplastic resin.

Solution to Problem

The invention is a three-dimensional net-like structure made from polyester having a swelling ratio dependent on a shear rate and configured to have a curled spring structure of filaments randomly brought into contact with and tangled with each other, have a three-dimensional striped sparse-dense configuration in a lateral direction relative to an extrusion direction, and have a filament diameter of 0.2 to 1.3 mm and a bulk density of 0.01 to 0.2 g/cm$^3$, wherein the swelling ratio is shown as $D_2/D_1$ against shear rate when the polyester in molten state is extruded to the filaments from a capillary having a tube inner diameter $D_1$ of 1.0 mm and a length of 10 mm at a temperature of 210° C. and $D_2$ denotes a diameter of cross section of the polyester filaments extruded and cooled down.

The swelling ratio is 1.00 to 1.60 and is preferably 1.10 to 1.50 in a shear rate range of 25 to 1000/sec.

The swelling ratio of the polyester is 1.10 to 1.38 at a shear rate of 60.8 sec$^{-1}$, is 1.12 to 1.39 at a shear rate of 122 sec$^{-1}$, is 1.15 to 1.42 at a shear rate of 243 sec$^{-1}$, is 1.17 to 1.43 at a shear rate of 608 sec$^{-1}$ and is 1.19 to 1.47 at a shear rate of 1220 sec$^{-1}$.

The polyester preferably has a melt flow rate (hereinafter abbreviated as MFR) of 3.0 to 35 g/10 min and a density of 1.01 to 1.60 g/cm$^3$.

The polyester is a polyester block copolymer (A) having a high melting-point crystalline polymer segment (a) mainly comprised of a crystalline aromatic polyester unit and a low melting-point polymer segment (b) mainly comprised of an aliphatic polyether unit and/or an aliphatic polyester unit as main components.

Advantageous Effects of Invention

The three-dimensional net-like structure of the invention made from polyester having a specified swelling ratio and a specified density as the material has the three-dimensional striped sparse-dense configuration where sparse areas of low bulk density and dense areas of high bulk density appear alternately in an extrusion direction during production. The three-dimensional net-like structure is thus made adequately flexible in the extrusion direction and is smoothly bendable without making squeaking noise in the application to a mattress, for example, for a care bed or a sofa bed. The mattress to which the three-dimensional net-like structure of the invention is applied favorably has soft texture. The three-dimensional net-like structure of the invention has the enhanced heat-resistant temperature and causes no problem when being washed with hot water of 80 degrees Celsius or higher temperature and dried.

BRIEF DESCRIPTION OF DRAWINGS

FIG. 9(*a*) is a perspective view and FIG. 9(*b*) is a front view seen from an extrusion direction during production;

FIG. 10(*a*) is a perspective view and FIG. 10(*b*) is a front view seen from the extrusion direction during production;

FIG. 11(*a*) is a perspective view and FIG. 11(*b*) is a front view seen from the extrusion direction during production.

DESCRIPTION OF EMBODIMENTS

Figure 1:
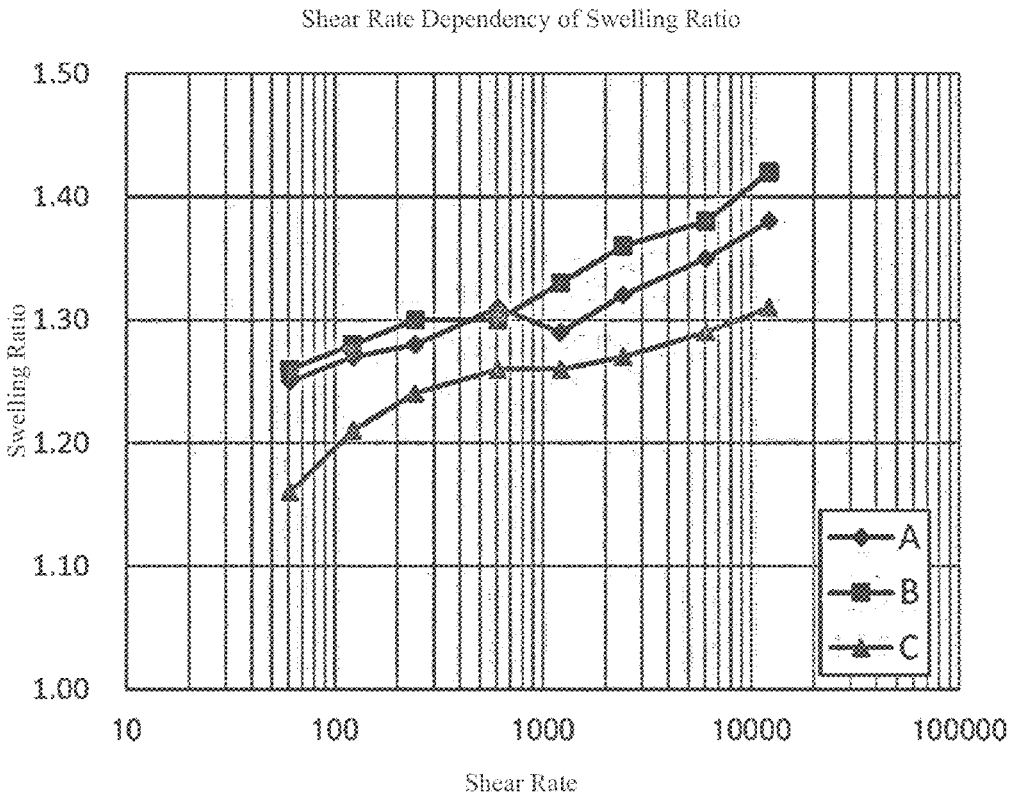
FIG. 1 is a graph showing shear rate dependency of swelling ratio of three-dimensional net-like structures according to an embodiment of the invention.

According to one embodiment, there is provided a three-dimensional net-like structure made from polyester having the characteristic of increasing the swelling ratio and configured to have a curled spring structure of filaments randomly brought into contact with and tangled with one another, have a three-dimensional striped sparse-dense configuration in a lateral direction relative to an extrusion direction and have a filament diameter of 0.2 to 1.3 mm and a bulk density of 0.01 to 0.2 g/cm$^3$. The swelling ratio herein is shown as $D_2/D_1$ against the shear rate when molten polyester is extruded to filaments from a capillary having a tube inner diameter $D_1$ of 1.0 mm and a length of 10 mm at a temperature of 210° C. and $D_2$ denotes a diameter of cross section of the polyester filaments extruded and cooled down. The swelling ratio in a shear rate range of 25 to 1000/sec is preferably 1.00 to 1.60 and is more preferably 1.10 to 1.50.

The present invention uses a thermoplastic resin having a specified swelling ratio, a specified MFR and a specified density as the raw material to provide a three-dimensional striped sparse-dense configuration and thereby enhance the bendability of a resulting three-dimensional net-like structure having the three-dimensional striped sparse-dense configuration. The thermoplastic resin material used in the invention is polyester and is preferably a polyester block copolymer (A) having a high melting-point crystalline polymer segment (a) mainly comprised of a crystalline aromatic polyester unit and a low melting-point polymer segment (b) mainly comprised of an aliphatic polyether unit and/or an aliphatic polyester unit as main components. The density of polyester as the material of the three-dimensional net-like structure is preferably 1.01 to 1.60 g/cm$^3$ and is more preferably 1.05 to 1.20 g/cm$^3$. The MFR of polyester is preferably 3.0 to 35 g/10 min. The following describes the polyester block copolymer (A) more in detail.

The high melting-point crystalline polymer segment (a) of the polyester block copolymer (A) used in the invention is not specifically limited but may be any high melting-point crystalline polymer that does not interfere with the advantageous effects of the invention. The high melting-point crystalline polymer segment (a) is preferably a polyester made of an aromatic dicarboxylic acid or its ester derivative and an aliphatic diol and is more preferably polybutylene terephthalate derived from terephthalic acid and/or dimethyl terephthalate and 1,4-butanediol. The high melting-point crystalline polymer segment (a) may additionally include a polyester derived from: a dicarboxylic acid component, such as isophthalic acid, phthalic acid, naphthalene-2,6-dicarboxylic acid, naphthalene-2,7-dicarboxylic acid, diphenyl-4,4'-dicarboxylic acid, diphenoxyethane dicarboxylic acid, 5-sulfoisophthalic acid, and their ester derivatives; and a diol having the molecular weight of not greater than 300, e.g., an aliphatic diol such as ethylene glycol, trimethylene glycol, pentamethylene glycol, hexamethylene glycol, neopentyl glycol and decamethylene glycol, an alicyclic diol such as 1,4-cyclohexanedimethanol and tricyclodecanedimethylol, or an aromatic diol such as xylylene glycol, bis(p-hydroxy) diphenyl, bis(p-hydroxyphenyl)propane, 2,2-bis[4-(2-hydroxyethoxy)phenyl]propane, bis[4-(2-hydroxy)phenyl]sulfone, 1,1-bis[4-(2-hydroxyethoxy)phenyl]cyclohexane, 4,4'-dihydroxy-p-terphenyl, 4,4'-dihydroxy-p-quaterphenyl; or a copolyester using two or more of these dicarboxylic acid components and two or more of these diol components in combination.

The low melting-point polymer segment (b) of the polyester block copolymer (A) used in the invention is not specifically limited but may be any low melting-point polymer segment comprised of an aliphatic polyether unit and/or an aliphatic polyester unit which does not interfere with the advantageous effects of the invention. Available examples of the aliphatic polyether include poly(ethylene oxide)glycol, poly(propylene oxide)glycol, poly(tetramethylene oxide) glycol, poly(hexamethylene oxide)glycol, copolymer of ethylene oxide and propylene oxide, ethylene oxide-addition polymer of poly(propylene oxide)glycol and copolymer of ethylene oxide and tetrahydrofuran. Available examples of the aliphatic polyester include poly(ϵ-caprolactone), polyenantholactone, polycaprylolactone, polybutylene adipate and polyethylene adipate. Among these aliphatic polyethers and/or aliphatic polyesters, in terms of the elastic property of the resulting polyester block copolymer, preferable are poly (tetramethylene oxide)glycol, ethylene oxide-addition polymer of poly(propylene oxide)glycol, poly(ϵ-caprolactone), polybutylene adipate and polyethylene adipate. The number-average molecular weight of the low melting-point polymer segment is preferably about not less than 600 but not greater than 4000 in the copolymerized state. The amount of the low melting-point polymer segment (b) in the polyester block copolymer (A) used in the invention is not specifically limited but is preferably about 10 to 90 wt %, is more preferably about 30 to 85 wt % and is especially preferably about 50 to 80 wt %. The amount of the low melting-point polymer segment (b) that is less than 10 wt % causes deterioration of the flexibility and the bending fatigue strength. The amount of the low melting-point polymer segment (b) that is greater than 90 wt %, on the other hand, causes insufficient mechanical properties, high-temperature properties, oil resistance and chemical resistance.

The polyester block copolymer (A) used in the invention is not specifically limited but may be any polyester block copolymer that does not interfere with the advantageous effects of the invention and may be, for example, a commercially available product. Typical examples of the commercially available product include "Hytrel" (registered trademark) manufactured by DU PONT-TORAY CO., LTD., "PELPRENE" (registered trademark) manufactured by TOYOBO CO., LTD., "PRIMALLOY" (registered trademark) manufactured by Mitsubishi Chemical Corporation, and "Nichigo-POLYESTER" (registered trademark) manufactured by the Nippon Synthetic Chemical Industry Co., Ltd. Specific examples, though not limited to, include: Hytrel G3548L, 3046, 4057WL20, 4057N, 4047N, 4767N, 5557, 6347, 7247, 2571, 2751, 5557M, 6347M, 7247M, 4275BK, 7247R09 and 7237F (manufactured by DU PONT-TORAY CO., LTD.); PELPRENE 40H, P40B, P30B, P40BU, P40U, P48U, P55U, P55B, P90BD, P80C, S1002, S2002, S3002, S6002 and S9002 (manufactured by TOYOBO CO., LTD.); PRIMALLOY A1500N, A1600N, A1700N, A1800N, A1900N, A1606C, A1706C, A1602N, A1704N, A1610N, A1710N, B1902N, B1900N, B1903N, B1910N, B1920N, B1922N, B1932N, B1942N, B1600N, B1700N, B1800N and B1921N (manufactured by Mitsubishi Chemical Corporation); and Nichigo-POLYESTER SP-154, SP-160, SP-176, SP-165, SP-170, SP-185, WR-901, WR-905, WR-960, TP-220, TP-217, TP-290, TP-249, LP-033, LP-011, LP-035, LP-050, TP-235, TP-293 and TP-219 (manufactured by the Nippon Synthetic Chemical Industry Co., Ltd.)

The polyester block copolymer (A) used in the invention may be produced by any of known methods. Applicable production methods include: for example, a method of causing a transesterification reaction of a lower alcohol diester of a dicarboxylic acid, an excess of a low molecular-weight glycol and the low melting-point polymer segment component in the presence of a catalyst and polycondensing the resulting reaction product; a method of causing an esterification reaction of a dicarboxylic acid, an excess of a glycol and the low melting-point polymer segment component in the presence of a catalyst and polycondensing the resulting reaction product; and a method of linking the high melting-point crystalline polymer segment and the low melting-point polymer segment with a chain linking agent. When poly(ϵ-caprolactone) is used for the low melting-point polymer segment, an applicable method may cause an addition reaction of adding ϵ-caprolactone monomer to the high melting-point crystalline polymer segment.

Figure 9:
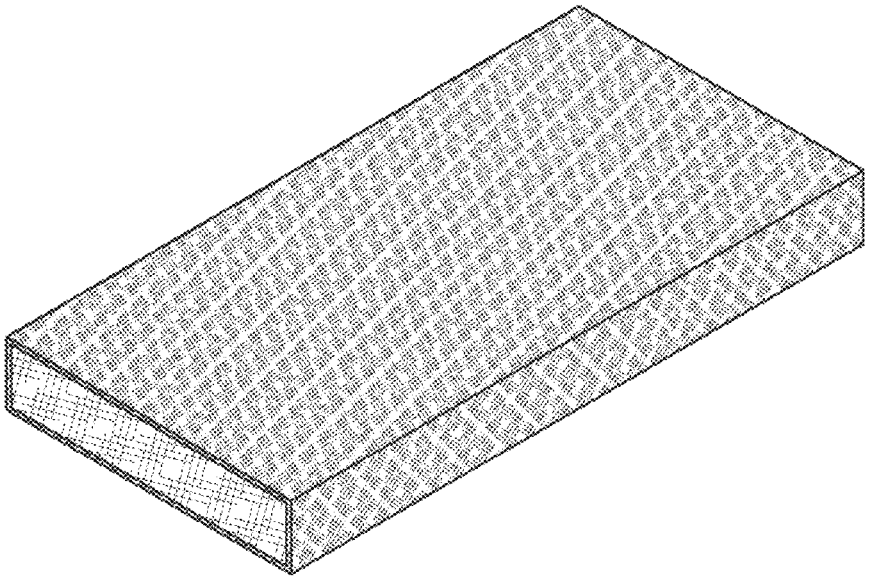
FIG. 9 is diagrams illustrating a three-dimensional net-like structure having a surface layer (densely-shaped outer peripheral area) according to an embodiment of the invention.
Figure 9:
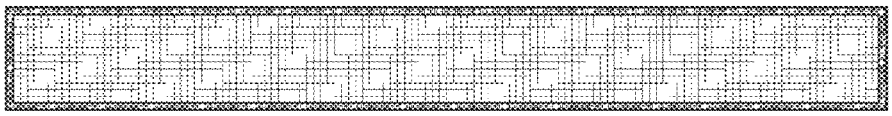
Figure 10:
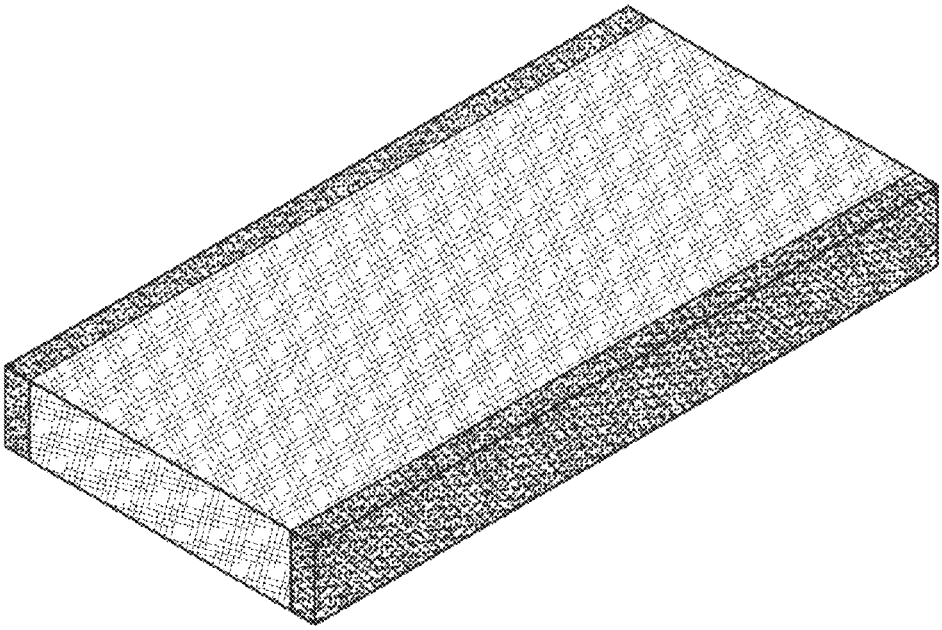
FIG. 10 is diagrams illustrating a three-dimensional net-like structure having both side areas of the increased bulk density (densely-hatched both side areas) according to another embodiment of the invention.
Figure 10:
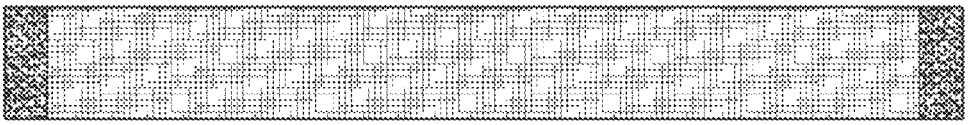
Figure 11:
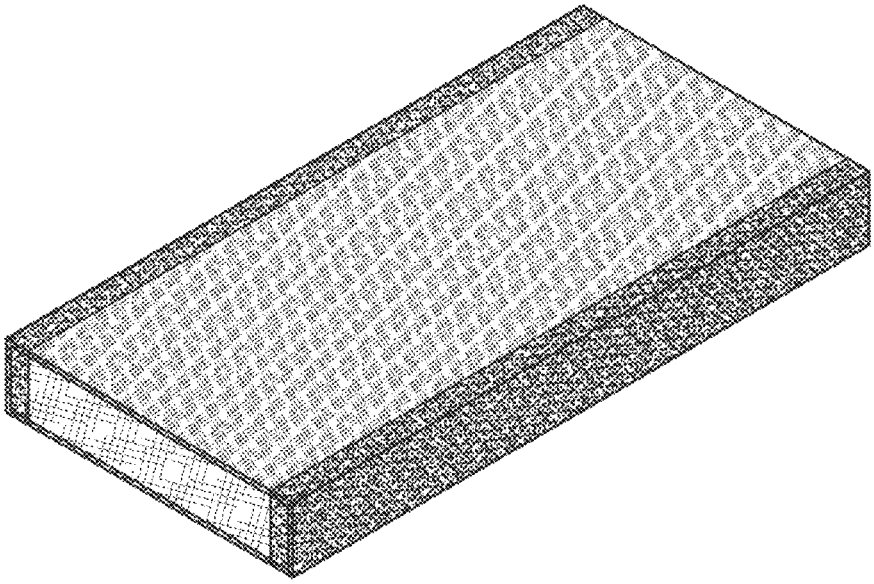
FIG. 11 is diagrams illustrating a three-dimensional net-like structure having a surface layer (densely-shaded outer peripheral area) and both side areas of the increased bulk density (densely-hatched both side areas) according to another embodiment of the invention.
Figure 11:
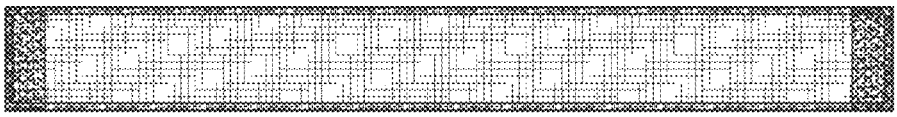

For example, Patent Literatures 1 and 2 should be referred to for the detailed production method of the three-dimensional net-like structure. The invention is applicable to a three-dimensional net-like structure having a surface layer of the higher bulk density than the other area on its outer periphery (FIG. 9). The invention is also applicable to a three-dimensional net-like structure having both side areas of the higher bulk density than the other area (FIG. 10). The invention is further applicable to a three-dimensional net-like structure having a surface layer and both side areas of the higher bulk density than the other area (FIG. 11). The bulk density of the three-dimensional net-like structure is preferably 0.01 to 0.2 g/cm$^3$. The areas of the higher bulk density, such as the surface area may, however, need not to have the bulk density of this range.

The swelling ratio denotes a value by dividing the diameter of the extruded resin by the diameter of the capillary when the molten resin is extruded from the capillary which is a thin cylindrical tube and is dependent on the shear rate. More specifically, the swelling ratio herein is shown as $D_2/D_1$, where $D_1$ denotes the diameter of the capillary (tube inner diameter) used to extrude the molten thermoplastic resin to filaments and $D_2$ denotes the diameter of the cross section of the extruded filament. The following describes the shear rate dependency of the swelling ratio and a measurement test for the relevant shear rate dependency of the melt viscosity. Sample A used Hytrel 3046 mentioned above; Sample B used Hytrel 4057N mentioned above; and Sample C used Hytrel 4057WL20 mentioned above. These samples A to C were all made from these polyesters according to the embodiment of the invention.

The following describes a measurement method and a measurement device of the swelling ratio. The same measurement device as that for a melt indexer (MI) to measure the melt flow rate (MFR) is employed for the measurement device of the swelling ratio. CAPILOGRAPH 1D (manufactured by Toyo Seiki Seisaku-sho, Ltd.) was used for this purpose. The material resin is extruded at an extrusion rate of 3 g/10 min under application of a pressure on the capillary having the tube inner diameter $D_1$ of 1.0 mm and the length of 10 mm at the temperature of 210° C. The filaments of the extruded material resin are cooled down with an alcohol. $D_2$ denotes the diameter of the cross section of the filament. The swelling ratio is calculated as $D_2/D_1$. The swelling ratio was measured at different shear rates of the material resin.

The relationship between the swelling ratio and the shear rate is described. The swelling ratio is dependent on the shear rate and increases with an increase in shear rate. The shear rate denotes a temporal change of shear deformation and is synchronous with velocity gradient. When two parallel layers distant from each other by "a" (cm) has a velocity difference "b" (cm/sec), the shear rate is expressed as b/a (1/sec).

An apparent shear rate is given by the following calculation formula. In the description hereof, the apparent shear rate as average value is used as the shear rate.

$$\gamma=4Q/\pi r^3$$

where γ denotes the apparent shear rate (sec$^{-1}$), r denotes the radius (cm) of the capillary, and Q denotes the flow rate (cm$^3$/sec).

When τ denotes an apparent shear stress and η denotes an apparent melt viscosity, the apparent melt viscosity is given as:

$$\eta=\tau/\gamma$$

A flat nozzle having a ratio $L/D_1$=10 mm/1.0 mm was used for measurement at the measurement temperature of 210° C., where L denotes the length of the capillary and $D_1$ denotes the diameter of the capillary. CAPILOGRAPH manufactured by Toyo Seiki Seisaku-sho, Ltd. was used as the measurement device.

Table 1 shows the results of measurement on the shear rate dependency of the swelling ratio. FIG. 1 is a graph corresponding to Table 1. The plots in the graph of FIG. 1 show the tendency of increasing the swelling ratio with an increase in shear rate. Sample A has a slight decrease in swelling ratio from 1.31 to 1.29 with an increase in shear rate from 608 sec$^{-1}$ to 1220 sec$^{-1}$ but still shows an increasing tendency of the swelling ratio as a whole. The invention is applied even in the event of an exceptional decrease in swelling ratio with an increase in shear rate due to, for example, a measurement error during specific measurement.

Figure 3:
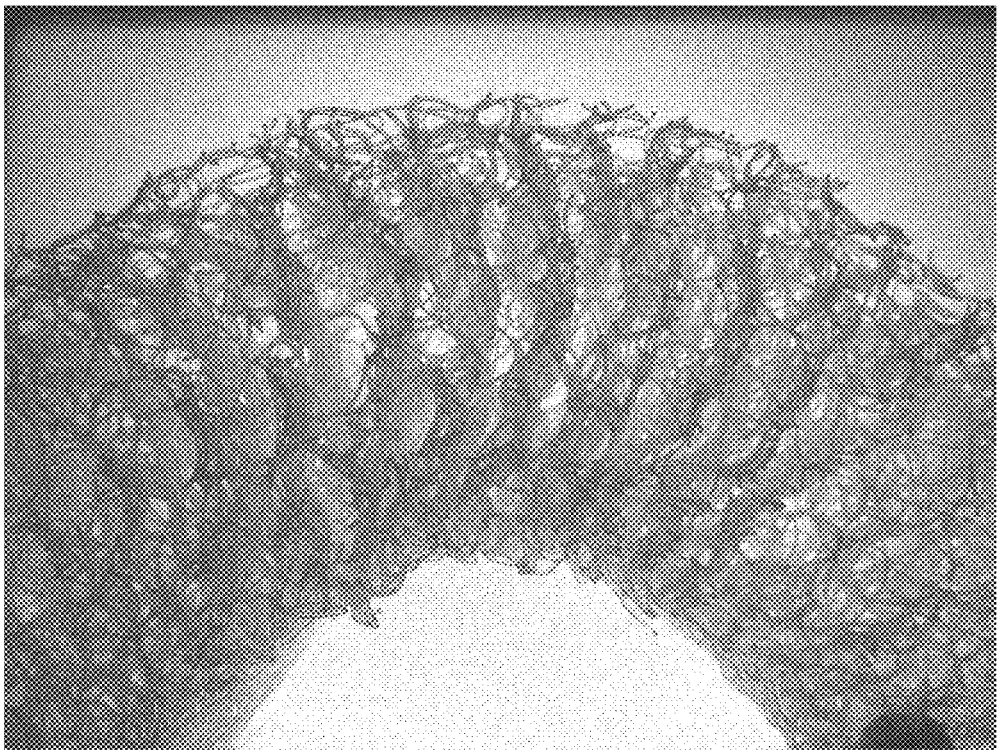
FIG. 3 is a side view photograph of a three-dimensional net-like structure according to an embodiment of the invention in the bent state.
Figure 4:
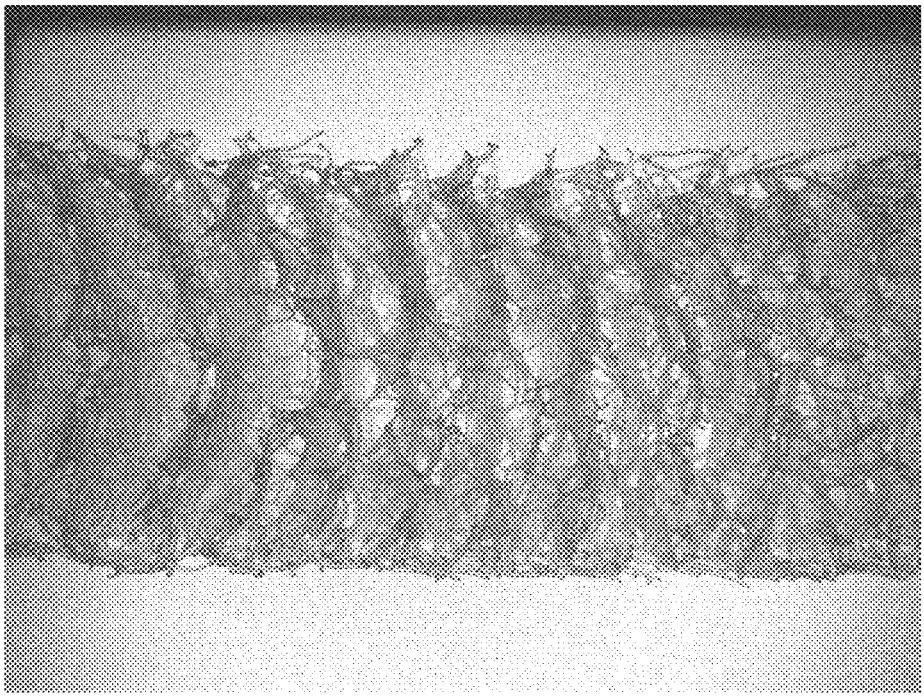
FIG. 4 is a side view photograph of the three-dimensional net-like structure of FIG. 3 in the non-bent state.
Figure 5:
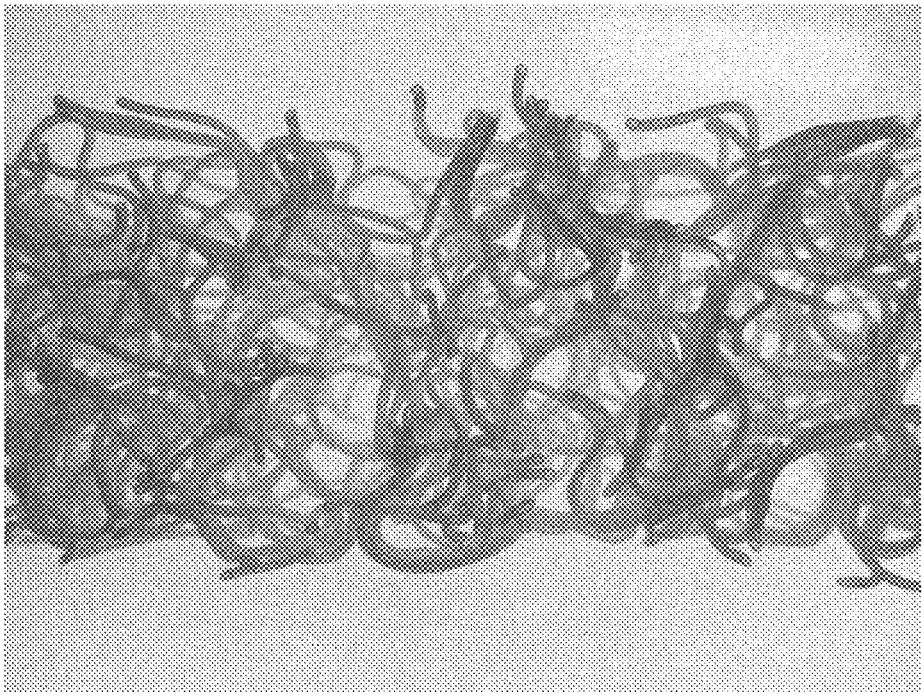
FIG. 5 is a side view photograph of a three-dimensional net-like structure of a comparative example without a striped sparse-dense configuration in the non-bent state.
Figure 6:
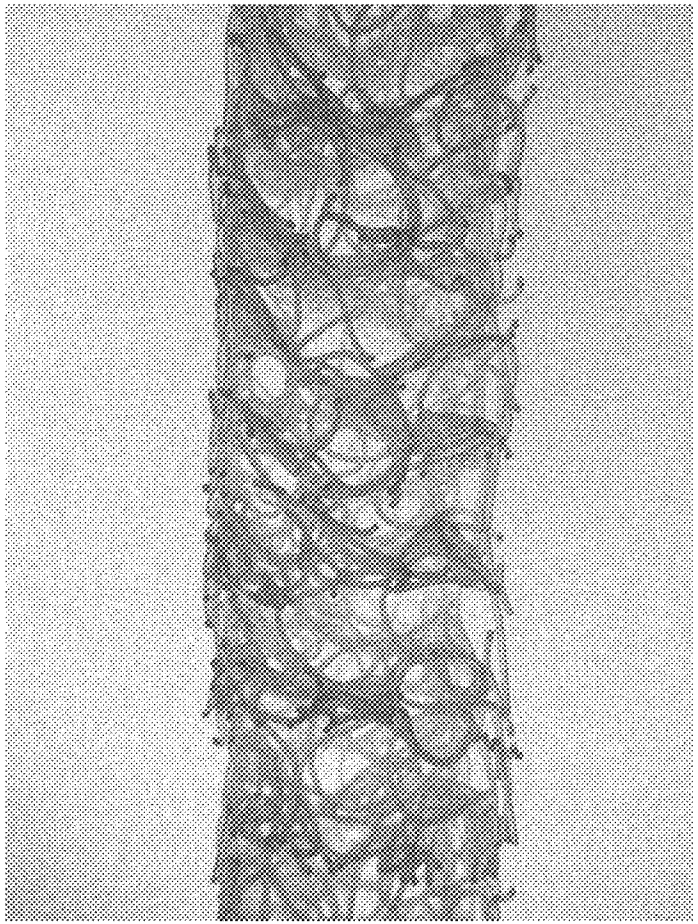
FIG. 6 is a side view photograph of a three-dimensional net-like structure of another comparative example without a striped sparse-dense configuration in the non-bent state.

The preferable range of the swelling ratio is 1.10 to 1.38 at the shear rate of 60.8 sec$^{-1}$, is 1.12 to 1.39 at the shear rate of 122 sec$^{-1}$, is 1.15 to 1.42 at the shear rate of 243 sec$^{-1}$, is 1.17 to 1.43 at the shear rate of 608 sec$^{-1}$ and is 1.19 to 1.47 at the shear rate of 1220 sec$^{-1}$. The swelling ratio set to the preferable range forms a three-dimensional striped sparse-dense configuration in the direction orthogonal to the extrusion direction and accordingly provides a three-dimensional net-like structure with the high bendability as shown in FIGS. 3 and 4.

TABLE 1

| | Swelling Ratios at Different Shear Rates | | | | | | | |
|---|---|---|---|---|---|---|---|---|
| Product | 60.8 | 122 | 243 | 608 | 1220 | 2430 | 6080 | 12200 |
| A | 1.25 | 1.27 | 1.28 | 1.31 | 1.29 | 1.32 | 1.35 | 1.38 |
| B | 1.26 | 1.28 | 1.30 | 1.30 | 1.33 | 1.36 | 1.38 | 1.42 |
| C | 1.16 | 1.21 | 1.24 | 1.26 | 1.26 | 1.27 | 1.29 | 1.31 |

Figure 2:
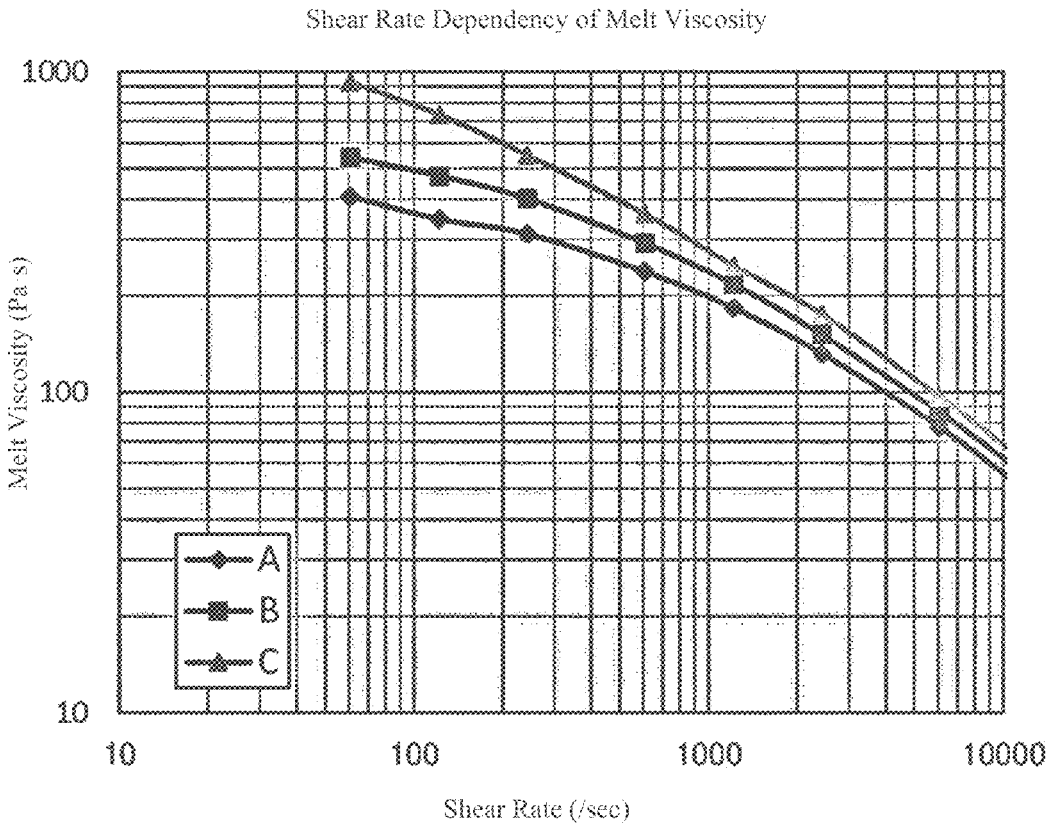
FIG. 2 is a graph showing shear rate dependency of melt viscosity of the three-dimensional net-like structures according to the embodiment of the invention.

Table 2 shows the results of measurement on the shear rate dependency of the melt viscosity. FIG. 2 is a graph corresponding to Table 2. The plots in the graph of FIG. 2 are decreasing curves.

TABLE 2

| Product | Melt Viscosities at Different Shear Rates (Pa · s) | | | | | | | |
|---|---|---|---|---|---|---|---|---|
| | 60.8 | 122 | 243 | 608 | 1220 | 2430 | 6080 | 12200 |
| A | 408 | 347 | 312 | 238 | 183 | 132 | 77.7 | 48.5 |
| B | 540 | 473 | 402 | 292 | 217 | 151 | 86.6 | 54.2 |
| C | 930 | 734 | 549 | 360 | 248 | 175 | 96.7 | 59.6 |

In general, an organic high-molecular material such as polymer has entangled molecules during flow. These tangles are likely to be released by the shear force during flow. The melt viscosity accordingly decreases with an increase in shear rate as shown in Table 2. The decrease in melt viscosity leads to a decrease in swelling ratio. The swelling ratio is, however, affected by the extrusion pressure more significantly, so that the swelling ratio tends to increase with an increase in shear rate as shown in Table 1.

The following describes control of the swelling ratio D2/D1 in production of the three-dimensional net-like structure. As understood from Table 1, the swelling ratio increases with an increase in shear rate, i.e., with an increase in extrusion rate. At a fixed shear rate, the material having the lower MFR has the higher swelling ratio. At a fixed shear rate, the lower molding temperature causes the higher swelling ratio. Under the conditions of fixed shear rate, material composition and molding temperature, the lower take-over speed causes the higher swelling ratio. The swelling ratio also increases with a decrease in air gap (distance between the capillary and the cooling water surface). The swelling ratio increases with an increase in ratio $L/D_1$ of the length L to the diameter $D_1$ of the capillary.

The following describes the repulsive force of the three-dimensional net-like structure according to the embodiment of the invention. The repulsive force of the three-dimensional net-like structure varies with a variation of the swelling ratio or the bulk density of the material. The repulsive force was measured by a load applied to compress each sample by 10 mm via a disk of 150 mm. More specifically, a load was applied in a middle area of each mattress as a sample, and the forces applied to sink the mattress by 10 mm, 20 mm and 30 mm were measured as the repulsive forces. The measurement devices used were a digital force gauge ZPS and a load cell ZPS-DPU-1000N manufactured by IMADA CO., LTD. Under the same manufacturing conditions including the take-over speed of a haul-off machine, the three-dimensional net-like structure made of the material resin having the specified swelling ratio and the specified density according to the embodiment of the invention had sinks of not greater than 50% in the 80000 repeated 50%-compression test, compared with a conventional product of three-dimensional net-like structure made of EVA as the material. During production of the three-dimensional net-like structure, the fibers form the striped structure in the resin flow direction, which suppresses a decrease in repulsive force by 50% or more. The product weight at a fixed repulsive force is also reduced by 10% or more.

In the three-dimensional net-like structure having the surface layer according to the embodiment of the invention, the high bulk density of the surface layer causes the three-dimensional net-like structure not to be bendable or not to be easily bendable. In order to bend the three-dimensional net-like structure well, the thickness of the surface layer is preferably 0.3 to 3.5 mm. Preferably, the weight range of the surface layer is 0.1 to 1.6 g (measured for the dimensions of 30 mm in length×30 mm in width×4 m in thickness; converted bulk density of 0.028 to 0.444 g/cm$^3$), and the filament diameter of the surface layer is 0.1 to 2.0 mm. Especially preferably, the weight range of the surface layer of the three-dimensional net-like structure is 0.3 to 1.5 g (converted bulk density of 0.083 to 0.417 g/cm$^3$), and the filament diameter of the surface layer is 0.2 to 1.3 mm. Most preferably, the weight range of the surface layer of the three-dimensional net-like structure is 0.5 to 1.2 g (converted bulk density of 0.139 to 0.333 g/cm$^3$), and the filament diameter of the surface layer is 0.3 to 0.9 mm.

The three-dimensional net-like structure according to the embodiment of the invention is readily bendable and makes no squeaking noise during bending. The three-dimensional net-like structure according to the embodiment of the invention has soft texture and is suitable for mattresses. Additionally, the three-dimensional net-like structure according to the embodiment of the invention has the enhanced heat-resistant temperature and causes no problems when being washed with hot water of 80 degrees Celsius or higher temperature and dried, so as to be readily kept clean.

FIGS. 3 and 4 show a three-dimensional net-like structure according to an embodiment of the invention respectively in the bent state and in the non-bent state. FIGS. 5 to 8 show prior art three-dimensional net-like structures as comparative examples in the bent state or in the non-bent state. The three-dimensional net-like structure according to the embodiment of the invention has the three-dimensional striped sparse-dense configuration (FIG. 4) and thereby causes no substantial wrinkles inside of a bend in the bent state (FIG. 3). The prior art structure, on the other hand, does not have the three-dimensional striped sparse-dense configuration and causes irregular wrinkles inside of a bend in the bent state. In an application of the three-dimensional net-like structure to a bed mattress, such wrinkles cause poor usability and early deterioration of the product. The three-dimensional net-like structure according to the embodiment of the invention suppresses the occurrence of such irregular wrinkles and solves such potential problems.

Figure 7:
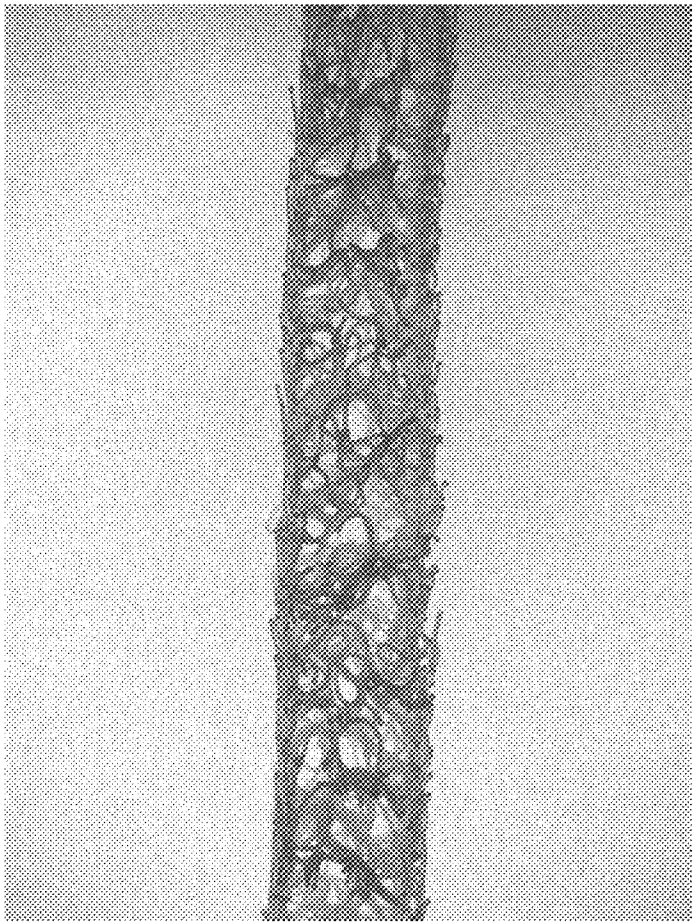
FIG. 7 is a side view photograph of a three-dimensional net-like structure of another comparative example with a striped sparse-dense configuration in the non-bent state.
Figure 8:
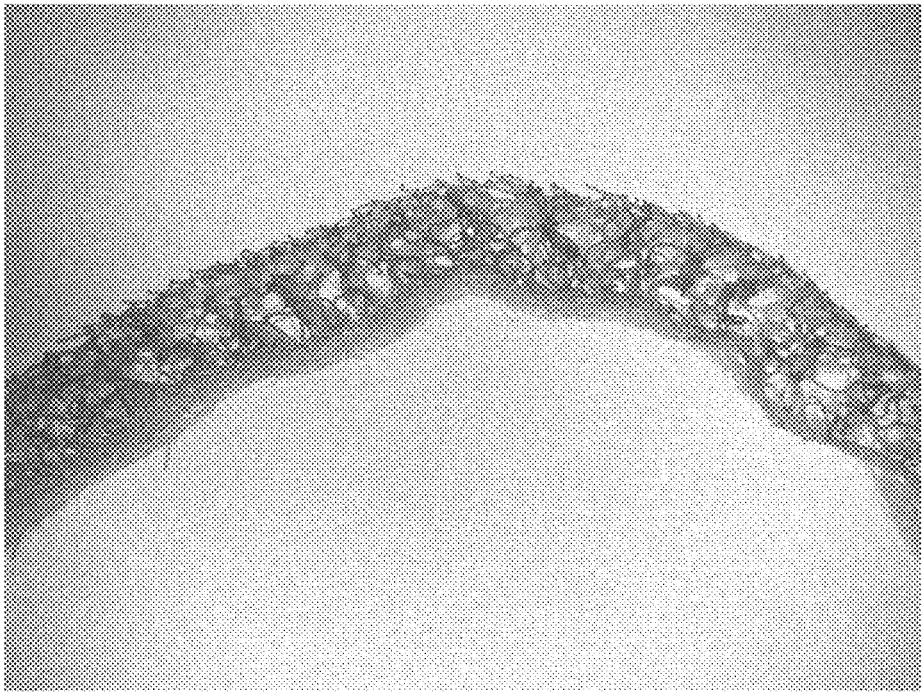
FIG. 8 is a side view photograph of the three-dimensional net-like structure of FIG. 7 in the bent state.

A three-dimensional net-like structure having a sparse-dense configuration has conventionally been producible by increasing and decreasing the take-over speed of a haul-off machine. The resulting sparse-dense configuration, however, has randomly-arranged sparse-dense repeating units as shown in FIG. 7 or large sparse-dense repeating units and accordingly has a difficulty in bending smoothly. This causes irregular wrinkles as shown in FIG. 8. This prior art method needs frequent speed change of the haul-off machine and accordingly has a problem of low production efficiency. An embodiment of the invention, on the other hand, uses polyester having the specified swelling ratio and the specified density described above as the material to form a three-dimensional striped sparse-dense configuration having the adequate sparse-dense repeating units and produce a smoothly-bendable three-dimensional net-like structure without reducing the production efficiency. Additionally, the embodiment of the invention is applicable to the increasing and decreasing take-over speed of the haul-off machine, as well as to the constant take-over speed of the haul-off machine. This contributes to production of three-dimensional net-like structures of various properties.

In general, the three-dimensional net-like structure having the surface layer is not easily bendable and causes irregular wrinkles under application of an increased bending load. Another embodiment of the invention is a three-dimensional net-like structure having a surface layer as shown in FIG. 9. This three-dimensional net-like structure is more easily bendable, compared with the prior art three-dimensional net-like structure. Even if some wrinkles are caused by bending the three-dimensional net-like structure, the three-dimensional striped sparse-dense configuration prevents no unnatural deformation of the filament structure but causes regular streaks along the three-dimensional striped sparse-dense configuration. This minimizes the poor usability and the early deterioration of the product described above. The three-dimensional striped sparse-dense configuration ensures the good water permeation and the good water drainage to be dried quickly. The three-dimensional net-like structure according to the embodiment of the invention is thus favorably applied to mattresses for medical use, which are to be made readily washable.

The three-dimensional net-like structure having the increased bulk density on both sides is also not easily bendable. Another embodiment of the invention is such a three-dimensional net-like structure (FIG. 10). In an application of such a three-dimensional net-like structure to a mattress for medical use, bending of the mattress assists the patient's sitting posture for a long time. The harder sides of the mattress assist the patient to readily and steadily stand from the bed and enable the patient to sit on the edge of the bed. Another embodiment of the invention is a three-dimensional net-like structure having a surface layer and the increased bulk density on both sides (FIG. 11).

Another preferable embodiment of the invention is a three-dimensional net-like structure formed in a curved, different shape, for example, a seat cushion. The seat cushion of the three-dimensional net-like structure has the three-dimensional striped sparse-dense configuration and is thus readily bendable, light in weight and breathable. The sparse areas having the relatively high void ratio in the three-dimensional striped sparse-dense configuration has better air permeability, compared with the dense areas. This efficiently enables a disinfectant or a refresher sprayed on the seat cushion to be readily and homogeneously spread over the entire seat cushion.

In an application of the three-dimensional net-like structure according to the embodiment of the invention to, for example, a seat cushion, a person may feel some irregularities on the seat surface caused by the three-dimensional striped sparse-dense configuration. In order to relieve this problem, a surface layer may be provided on the three-dimensional net-like structure. A laminate material made of another material or the same material may be bonded to or thermally molded with the three-dimensional net-like structure according to the embodiment of the invention. This also solves the potential problem of the seat surface.

Figure 12:
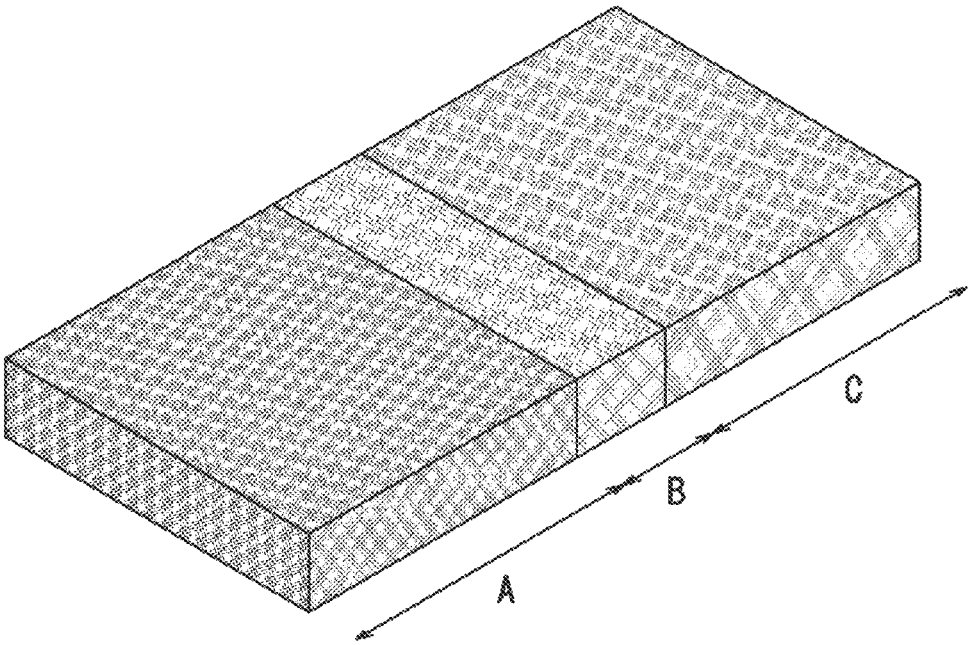
FIG. 12 is a perspective view illustrating an example of varying the bulk density in application of the three-dimensional net-like structure according to the embodiment of the invention to a seat, wherein the longitudinal direction corresponds to the extrusion direction during production.

In an application of the three-dimensional net-like structure to, for example, an automobile seat, the conventional three-dimensional net-like structure is not readily bendable, so that a seat member and a back member are generally formed by separately produced, different three-dimensional net-like structures. The three-dimensional net-like structure according to the embodiment of the invention is, on the other hand, readily bendable, so that a seat member and a back member can be formed by bending and folding one single three-dimensional net-like structure. One embodiment of the invention is a three-dimensional net-like structure having the three-dimensional striped sparse-dense configuration and the more significantly varying bulk density by increasing and decreasing the take-over speed. For example, as shown in FIG. 12, an area A is formed to have a high bulk density and to be used for a seat member; an area B is formed to have a low bulk density and to be used for a bend between the seat member and a back member; and an area C is formed to have an intermediate bulk density which is higher than that of the bend but is lower than that of the seat member and to be used for the back member. This provides the seat with the sufficient performances such as comfortableness, while allowing for the simplified production and assembly of the integral three-dimensional net-like structure, thus reducing the manufacturing cost.

Mixing an antimicrobial agent, a flame retardant or a non-combustible material with the polyester material changes the specific gravity and the viscosity and forms a three-dimensional net-like structure that is not readily bendable. The embodiment of the invention is, however, applicable to the material mixed with such additives. This enables production of a three-dimensional net-like structure having the non-combustible, flame-retardant and antimicrobial abilities and the improved bendability by the three-dimensional striped sparse-dense configuration. Using the polyester material improves the durability to make it unlikely to cause permanent set in fatigue and increases the heat-resistant temperature, compared with using the polyethylene material.

The following describes the relationship between the various conditions of an extruder and a haul-off machine used for production of three-dimensional net-like structures as measurement samples and the bulk density for bending the three-dimensional net-like structure well. Three-dimensional net-like structures having a thickness of 70 mm and a width of 460 mm were produced with an extruder having the screw diameter of 40 mm and a nozzle having the capillary diameter (nozzle diameter) of 1.0 mm. At the screw rotation speed of 70 rpm (extrusion rate of about 16 kg/hour), the take-over speed of the haul-off machine and the bulk density for bending the three-dimensional net-like structure well were respectively in the range of not lower than 2.5 mm/sec and in the range of not greater than 0.0635 g/cm$^3$. For example, under the conditions of the screw rotation speed of 70 rpm, the haul-off machine take-over speed of 2.3 mm/sec and the bulk density of 0.0690 g/cm$^3$, some wrinkles were observed on the surface when the three-dimensional net-like structure was bent. Under the conditions of the screw rotation speed of 70 rpm, the haul-off machine take-over speed of 2.5 mm/sec and the bulk density of 0.0635 g/cm$^3$, on the other hand, the three-dimensional net-like structure was bent well. In the three-dimensional net-like structure having a surface layer, the bulk density and the filament diameter of the surface layer for bending the three-dimensional net-like structure well were respectively in the range of 0.1 to 1.6 g/cm$^3$ and in the range of 0.3 to 1.2 mm. The combination of the bulk density and the filament diameter in these ranges enables the three-dimensional net-like structure having the varying bulk density in the thickness direction with a variation in nozzle diameter or a variation in number of nozzle holes to be bent well.

INDUSTRIAL APPLICABILITY

The three-dimensional net-like structure of the invention is applicable to cushions, sofas, beds (mattresses) and seats (other than sofas).

The invention claimed is:

1. A three-dimensional netted structure bendable in the direction of the extrusion direction made from polyester having a swelling ratio dependent on a shear rate and configured to have a curled spring structure of filaments randomly brought into contact with and tangled with each other, having a three-dimensional striped sparse-dense configuration in a lateral direction relative to an extrusion direction, and having a filament diameter of 0.2 to 1.3 mm and a bulk density of 0.01 to 0.2 g/cm$^3$, wherein the swelling ratio is shown as $D_2/D_1$ against shear rate when the polyester in molten state is extruded to the filaments from a capillary having a tube inner diameter $D_1$ of 1.0 mm and a length of 10 mm at a temperature of 210° C. and $D_2$ denotes a diameter of a cross section of the polyester filaments extruded and cooled down;

the swelling ratio of the polyester is 1.00 to 1.60 at a shear rate range of 25 to 1000/sec$^{-1}$;

the polyester is a polyester block copolymer (A) having a high melting-point crystalline polymer segment (a) mainly comprising a crystalline aromatic polyester unit and a low melting-point polymer segment (b) mainly comprising an aliphatic polyether unit and/or an aliphatic polyester unit as main components; and the three-dimensional netted structure has a surface layer in the extrusion direction which has a higher bulk density than the other area.

2. The three-dimensional netted structure of claim 1, wherein the swelling ratio is 1.10 to 1.50 in a shear rate range of 25 to 1000/sec$^{-1}$.

3. The three-dimensional netted structure of claim 2, wherein the swelling ratio of the polyester is 1.10 to 1.38 at a shear rate of 60.8 sec$^{-1}$, is 1.12 to 1.39 at a shear rate of 122 sec$^{-1}$, is 1.15 to 1.42 at a shear rate of 243 sec$^{-1}$, is 1.17 to 1.43 at a shear rate of 608 sec$^{-1}$, and is 1.19 to 1.47 at a shear rate of 1220 sec$^{-1}$.

4. A three-dimensional structure, the three-dimensional structure comprising polyester filaments, the polyester filaments comprising a polyester block copolymer, the polyester block copolymer comprising a high melting-point crystalline polymer segment and a low melting-point polymer segment; the high melting-point crystalline polymer segment comprising a crystalline aromatic polyester unit, the low melting-point polymer segment comprising an aliphatic polyether unit and/or an aliphatic polyester unit; each of the polyester filaments being produced by extruding polyester in molten state through a capillary to form an intermediate polyester filament and then cooling down the intermediate polyester filament, the polyester in the molten state having a shear rate;

wherein:

the polyester filaments have a curled spring shape and are randomly contacted and tangled with each other;

the three-dimensional structure comprises a plurality of sparse portions, a plurality of dense portions, and a surface layer;

the surface layer is in a sheet shape and has a sheet surface;

each of the plurality of sparse portions has a first density;

each of the plurality of dense portions has a second density;

the surface layer has a third density;

the first density is lower than the second density;

the second density is lower than the third density;

each of the plurality of sparse portions and each of the plurality of dense portions are disposed alternately along the sheet surface to form a sparse-dense configuration;

the polyester filaments have a filament diameter of 0.2 to 1.3 mm and a bulk density of 0.01 to 0.2 g/cm$^3$;

the polyester filaments have a swelling ratio;

the swelling ratio is defined as $D_2/D_1$, wherein $D_1$ denotes an inner diameter of the capillary and is 1.0 mm, and the capillary has a length of 10 mm, and $D_2$ denotes a diameter of a cross section of the polyester filaments; and the swelling ratio is 1.00 to 1.60 when the shear rate is 25 to 1000 sec$^{-1}$.

5. The three-dimensional structure of claim 4, wherein the polyester filaments comprise an antimicrobial agent.

6. The three-dimensional structure of claim 5, wherein the swelling ratio is 1.10 to 1.50 when the shear rate range is 25 to 1000/sec$^{-1}$.

7. The three-dimensional structure of claim 6, wherein the swelling ratio of the polyester is 1.10 to 1.38 when the shear rate is 60.8 sec$^{-1}$, the swelling ratio of the polyester is 1.12 to 1.39 when the shear rate is 122 sec$^{-1}$, the swelling ratio of the polyester is 1.15 to 1.42 when the shear rate is 243 sec$^{-1}$, the swelling ratio of the polyester is 1.17 to 1.43 when the shear rate is 608 sec$^{-1}$, or the swelling ratio of the polyester is 1.19 to 1.47 when the shear rate is 1220 sec$^{-1}$.

* * * * *